US011738786B2

(12) United States Patent
Pelz et al.

(10) Patent No.: US 11,738,786 B2
(45) Date of Patent: Aug. 29, 2023

(54) METHOD AND DEVICE FOR MONITORING A HAZARD ZONE OF A LEVEL CROSSING

(71) Applicant: SIEMENS MOBILITY GMBH, Munich (DE)

(72) Inventors: Markus Pelz, Schandelah (DE); Anna-Janina Bednarek, Braunschweig (DE)

(73) Assignee: Siemens Mobility GmbH, Munich (DE)

( * ) Notice: Subject to any disclaimer, the term of this patent is extended or adjusted under 35 U.S.C. 154(b) by 527 days.

(21) Appl. No.: 16/961,750

(22) PCT Filed: Dec. 21, 2018

(86) PCT No.: PCT/EP2018/086533
§ 371 (c)(1),
(2) Date: Jul. 13, 2020

(87) PCT Pub. No.: WO2019/137798
PCT Pub. Date: Jul. 18, 2019

(65) Prior Publication Data

US 2021/0061327 A1 Mar. 4, 2021

(30) Foreign Application Priority Data

Jan. 12, 2018 (DE) ..... 102018200466.8

(51) Int. Cl.
*B61L 29/24* (2006.01)
*B61L 27/04* (2006.01)
*B61L 27/70* (2022.01)

(52) U.S. Cl.
CPC ..... *B61L 27/04* (2013.01); *B61L 27/70* (2022.01); *B61L 29/24* (2013.01)

(58) Field of Classification Search
CPC ..... B61L 27/04; B61L 27/70; B61L 29/08; B61L 29/30; B61L 29/00; B61L 29/24; B61L 29/32; G08G 1/01; G01S 13/04
See application file for complete search history.

(56) References Cited

U.S. PATENT DOCUMENTS 6,641,091 B1 * 11/2003 Hilleary ..... B61L 29/08 246/111
9,950,723 B2 4/2018 Lehnertz
(Continued)

FOREIGN PATENT DOCUMENTS

DE 26 56 706 A1 6/1978
DE 196 12 579 A1 10/1997
(Continued)

OTHER PUBLICATIONS

Car2X—Communication—ScienceDirect (Year: 2016).*
(Continued)

*Primary Examiner* — Mark T Le
(74) *Attorney, Agent, or Firm* — Laurence A. Greenberg; Werner H. Stemer; Ralph E. Locher

(57) ABSTRACT

A method that can be implemented relatively easily and inexpensively for monitoring a hazard zone of a level crossing, divides a roadway into a first roadway section and a second roadway section. For this purpose, the method is carried out such that by use of a first radio module, first radio signals are emitted in a first detection region containing at least one part of the first roadway section. By use of a second radio module, second radio signals are emitted in a second detection region containing at least one part of the second roadway section. The hazard zone is monitored indirectly using an analysis which is based both on the first emitted radio signals as well as the second emitted radio signals and which relates to the detection regions.

16 Claims, 3 Drawing Sheets

(56) References Cited

U.S. PATENT DOCUMENTS

| | | | | |
|---|---|---|---|---|
| 2014/0023995 | A1* | 1/2014 | Jones | G09B 9/003 434/11 |
| 2014/0375454 | A1* | 12/2014 | Konrad | H04N 7/18 340/552 |
| 2015/0071497 | A1* | 3/2015 | Kuusisto | G06V 20/52 382/107 |
| 2016/0133125 | A1 | 5/2016 | Sandbrook | |
| 2019/0185036 | A1* | 6/2019 | Mian | G06K 9/6293 |

FOREIGN PATENT DOCUMENTS

| | | | |
|---|---|---|---|
| DE | 699 20 829 | T2 | 10/2005 |
| DE | 102011052373 | A1 | 2/2013 |
| DE | 102013109641 | B3 | 9/2014 |
| DE | 10 2014 208 522 | A1 | 11/2015 |
| DE | 102016105312 | A1 | 9/2017 |
| DE | 102017209766 | A1 * | 12/2018 |
| EP | 2527227 | A2 | 11/2012 |
| EP | 2858039 | A1 | 4/2015 |
| EP | 2 937 260 | A1 | 10/2015 |
| FR | 3050426 | A1 | 10/2017 |

OTHER PUBLICATIONS

Adib Fadel et al: "3D Tracking via Body Radio Reflections", Massachusetts Institute of Technology, NSDI'14 Proceedings of the 11th USENIX Conference on Networked Systems Design and Implementation, Apr. 2-4, 2014, Seattle, WA, USA, pp. 317-329, ISBN 978-1-931971-09-6, URL:https://www.usenix.org/system/files/conference/nsd i 14/nsdi 14-paperadib.pdf, date:Nov. 29, 2017; 2014; Abstract—This paper introduces WiTrack, a system that tracks the 3D motion of a user from the radio signals reflected off her body. It works even if the person is occluded from the WiTrack device or in a different room. WiTrack does not require the user to carry any wireless device, yet its accuracy exceeds current RF localization systems, which require the user to hold a transceiver. Empirical measurements with a WiTrack prototype show that, on average, it localizes the center of a human body to within a median of 10 to 13 cm in the x and y dimensions, and 21 cm in the z dimension. It also provides coarse tracking of body parts, identifying the direction of a pointing hand with a median of 11.2° . WiTrack bridges a gap between RF-based localization systems which locate a userthrough walls and occlusions, and human-computer interaction systems like Kinect, which can track a user without instrumenting her body, but require the user to stay within the direct line of sight of the device.

Honeywell: "Radarscanner—Radarsensoranlage zur automatischen Gefahrenraum-Freimeldung von Bahnübergängen", Honeywell Regelsysteme GmbH, GE3S-6002 1098R1-MA; The document describes a radio sensor device for automatic clear signaling of point sections. The systems generates a related output signal "clear/occupied".

* cited by examiner

METHOD AND DEVICE FOR MONITORING A HAZARD ZONE OF A LEVEL CROSSING

BACKGROUND OF THE INVENTION

Field of the Invention

As points of intersection of track-bound, in particular rail-bound traffic with road traffic, level crossings represent potential hazard points. For this reason, it is usually necessary to provide protective measures to reduce the corresponding risks.

A method for monitoring level crossings with barriers is known for example from the company brochure "Radar scanner—radar sensor system for automatic hazard zone free status reporting for level crossings", Honeywell Regelsysteme GmbH, GE3S-6002 1098R1-MA. This describes a method and a device for automatic hazard zone free status reporting for level crossings. For this purpose, the device comprises a radar sensor for identifying objects or obstacles arranged between the barriers. In order to fulfil the requirements of European Standard EN 50129 with Safety Integrity Level 3 (SIL3 for short), the system functions of the known device are continuously checked by means of self-tests. The technical implementation of the appropriate tests requires relatively complex and cost-intensive safety technology.

SUMMARY OF THE INVENTION

The present invention is based on the object of disclosing a method for monitoring a hazard zone of a level crossing that is relatively simple and inexpensive to implement.

This object is achieved according to the invention by a method for monitoring a hazard zone of a level crossing, which divides a roadway into a first roadway section and a second roadway section, wherein first radio signals are emitted by means of a first radio module into a first identification region comprising at least one part of the first roadway section, second radio signals are emitted by means of a second radio module into a second identification region comprising at least one part of the second roadway section and the hazard zone is monitored indirectly using an analysis relating to the identification regions, which is based on both the first emitted radio signals and the second emitted radio signals.

According to the first step of the method according to the invention for monitoring a hazard zone of a level crossing, which divides a roadway into a first roadway section and a second roadway section, first radio signals are emitted by means of a first radio module into a first identification region comprising at least one part of the first roadway section. In a corresponding manner, according to the second step of the method according to the invention, second radio signals are emitted by means of a second radio module into a second identification region comprising at least one part of the second roadway section. Here, a radio module should be understood to be a device that is usually used for radio-based communication by means of the corresponding transmission of data by means of radio signals. This means that radio modules or radio signals emitted thereby are as such not usually actually intended to monitor a hazard zone or to detect objects in identification regions. According to the invention, corresponding radio signals are now emitted by means of the radio modules into a respective identification region, wherein the identification regions do not comprise or cover the hazard zone, or at least not completely. This means that direct monitoring of the actual hazard zone by means of the first radio signals and the second radio signals is neither attempted nor performed.

Instead, according to the third step of the method according to the invention, the hazard zone is monitored indirectly using an analysis relating to the identification regions, which is based on both the first emitted radio signals and the second emitted radio signals. This means that the first radio module and the second radio module are used as sensors or detectors in order to detect or identify objects in the respective identification region. This exploits the fact that is has been shown that it is also possible to detect and identify objects by means of commercially available radio modules. As an example of such investigations, reference is made to the specialist article "3D Tracking via Body Radio Reflections", ADIB, F., KABELAC, Z., KATABI, D., AND MILLER, R. C. (2014).

As already mentioned, the method according to the invention is in particular characterized by the fact it is not the actual hazard zone that is acquired or monitored by means of the radio modules, but only parts of the roadway sections adjacent thereto in each case on both sides of the level crossing. Here, the hazard zone of the level crossing is hence only monitored indirectly in that the status or changes in the status in the two identification regions are used to infer the corresponding status in the hazard zone of the level crossing. Depending upon the direction of movement of an object approaching or crossing the level crossing, for example in the form of a traffic participant, herein the two identification regions can also be called the approach region or the departure region. Herein, 'approach region' designates the identification region from which the object or the roadway traffic participant approaches the level crossing. Correspondingly, 'departure region' refers to the region in which the object leaves the hazard zone or the level crossing again after crossing the latter and thus has also passed the hazard zone. Since a level crossing can be crossed from both sides, the two roadside regions outside the barriers, i.e. the respective identification regions, are in each case an approach or departure region depending upon the situation. Therefore, any distinction in this regard is only for the purpose of the respective crossing process.

Reference is made to the fact that, as a rule, the steps of the method according to the invention will be repeated continuously or cyclically. This ensures that status changes in the identification regions and resulting status changes in the hazard region are identified reliably and promptly. Herein, it should be noted that in particular the first two method steps can be performed independently of one another, i.e. in particular also simultaneously.

The method according to the invention has the advantage that it enables the indirect monitoring of a hazard zone of a level crossing using radio modules that are produced in large quantities and are thus available on the market for low prices. This in particular provides the prerequisite for equipping or retrofitting level crossings with corresponding monitoring technology, which has not been the case to date, for example due to their infrequent use taking into account the costs arising from the corresponding monitoring. Moreover, the method according to the invention deliberately dispenses with direct monitoring of the hazard zone as such and instead derives the status of the hazard zone from the statuses of the two identification regions. This is in particular advantageous in cases in which, due to the prevailing circumstances and boundary conditions, direct monitoring of the hazard zone would not be readily possible or would be disadvantageous, for example due to the arrangement or alignment of existing radio modules to be used for the monitoring.

The method according to the invention can advantageously be used for both level crossings with full barriers and in particular for level crossings with on-call barriers. The latter type of level crossings mentioned, with which at least one demand-driven barrier, which is also called an on-call barrier, is closed in its standby status. Here, the request to open the barrier or barriers is usually issued via an intercom system with an interface to the signal box or dispatcher. After crossing the level crossing, the corresponding roadway traffic participant should sign off again at the opposite intercom system as a result of which the hazard zone is usually deemed to be cleared. In the case of motorized vehicles, it is moreover possible for the dispatcher to identify the crossing of the level crossing from the driving noise and for the level crossing to be subsequently deemed to be cleared. The barrier or barriers are then—optionally after a warning has been issued via the intercom and/or an audio signal at the level crossing—closed again. In particular for level crossings with on-call barriers, the method according to the invention can achieve a significant increase or improvement in safety for comparatively little effort and comparatively low costs. Similarly, additional safeguarding or assistance can be provided for level crossings with half barriers for which it is not absolutely necessary to report a free status of the hazard zone.

The analysis relating to the identification regions, which is based on both the first emitted radio signals and the second emitted radio signals, can in principle be carried out in different ways. Here, it is for example conceivable for additional radio receivers to be provided and for a received field strength received by the respective radio receivers or received power of the respective radio signals to be used for the analysis.

The method according to the invention is preferably developed such that in each case radio signals can also be received by means of the first radio module and the second radio module and the hazard zone is monitored indirectly using an analysis relating to the identification regions, which is based on the received radio signals. Hence, according to this development, the radio modules are in each case transmitting and receiving facilities so that the radio modules themselves can also be used simultaneously for the reception of radio signals. Here, the hazard zone is monitored indirectly using an analysis relating to the identification regions, which is based on the received radio signals, i.e. at least indirectly using the emitted radio signals. Herein, in principle the radio signals received by the radio modules can be both radio signals resulting from radio signals emitted by the actual respective radio module and radio signals that were emitted by the other radio module in each case.

According to a further preferred embodiment of the method according to the invention, during the course of the analysis, the first radio module exclusively takes into account the first radio signals and the second radio module exclusively takes into account the second radio signals. This means that the two radio modules in each case exclusively receive the radio signals emitted by the actual radio module in question and take these into account in the analysis relating to the respective identification region. This can, for example, take place in that the first radio module provides the first radio signals it emits with a first identifier and the second radio module correspondingly provides the second radio signals it emits with a second identifier. Subsequently, the first radio module will exclusively receive or further process first radio signals, i.e. radio signals with the first identifier, and the second radio module will exclusively receive or further process second radio signals, i.e. radio signals with the second identifier. This embodiment of the method according to the invention has the advantage that the analysis is simplified and it is possible to avoid possible interference or complications caused by taking into account the signal emitted radio signals emitted by the other radio module in each case.

Advantageously, the method according to the invention can also be embodied such that the analysis is performed taking into account a received power of the radio signals received by the respective radio module. Here, it is for example possible for the radio modules to be initially calibrated in standby status during which calibration a standby received power of the respective radio module is determined. Here, a standby status designates a status of the level crossing in which the two identification regions are free of objects or traffic participants and there are no other obstacles in these regions or their environment. This means that the nature of the environment is such as is usually the case for the majority of the time. The constant received powers obtained in this standby status on the basis of the emitted radio signals, which substantially result from signals reflected on objects in the environment, can be used as reference values or references during the course of the analysis. If, now, a roadway traffic participant or an obstacle moves into the first identification region for example, the first radio signals are reflected in accordance with the size and nature of the object. These reflected first radio signals are received by the first radio module so that the received power (or the received field strength) of the first radio module provides information on the status in the first identification region. A corresponding encoding, for example with a corresponding identifier in a header of the radio signals, enables the received radio signals to be identified as radio signals emitted by the actual respective radio module, i.e. in the present case, the first radio module. Herein, the course of the received power over time enables the movement of the object to be registered and traced until the object is no longer located in the first identification region, i.e. has left it. Analogously, after the level crossing has been crossed, the movement of the object away from the level crossing can be established using the course of the received power of the second radio module relating to the second radio signals. This means that the second radio signals can be used to obtain information relating to the status of the second identification region or relating to the status in the second identification region. Taking into account the status of both identification regions, i.e. using an analysis relating to the two identification regions, which is based on both the first emitted radio signals and the second emitted radio signals, it is hence possible, taking into account the received power of the radio signals received by the respective radio module, to indirectly monitor the hazard zone.

Additionally or alternatively to the above-described preferred development, the method according to the invention can advantageously also be characterized by the fact that the analysis is performed taking into account a running time of the radio signals received by the respective radio module. Hence, here, in accordance with the radar principle, the time taken by a radio signal from its emission to its reception is detected. Similarly to the procedure when taking account of the respective received power, here the radio modules emit permanently encoded signals in which the transmission time is acquired—preferably in a corresponding header. If a radio signal is reflected and received again by the radio module in question, it is possible to determine the time required for the route. This time and the speed of the radio signals (speed of light) can be used to determine the distance to the object on which the respective radio signal was reflected. It is preferably moreover possible to determine the direction to the object in question from the angle of the emitted and received radio signals and hence, in combination with the distance, the precise location or the precise position of the object. Herein, in the event of the analysis being performed taking into account the running time of the radio signals received by the respective radio module, it is also possible for the radio modules to be calibrated in relation to the idle status and taken into account in the analysis.

According to a particularly preferred development of the method according to the invention, during the course of the analysis, an object is identified in one of the identification regions. This is advantageous since a corresponding identification provides information on the current and/or future status of the hazard zone and moreover optionally enables further actions to be instigated.

Preferably, the method according to the invention can also be embodied such that, following the identification of the object, the opening of at least one barrier of the level crossing is initiated. This is advantageous since it in particular enables level crossings with on-call barriers to be partially or completely automated. Since on-call barriers are closed in their standby status, the additional function of identifying an approach can result in an announcement and/or opening of the barrier taking place or being initiated or instigated.

Preferably, the method according to the invention can further be developed such that, during the course of the analysis, it is identified that the object has moved out of the one of the identification regions into the hazard zone. This can, for example, take place in that it is identified that, during the course of approaching the level crossing, the object has initially moved into the respective identification region and then out of it again in the direction of the level crossing.

Preferably the method according to the invention can also be embodied such that, during the course of the analysis, the object is subsequently identified in the other one of the identification regions. Hence, in this case it can be inferred that the object has moved out of the one of the identification regions into the other one of the identification regions and has thereby passed the hazard zone when crossing the level crossing.

According to a further special preferred embodiment of the method according to the invention, it is identified during the course of the analysis that the object has left the hazard zone again. Depending upon the respective implementation, here the leaving of the hazard zone can be identified as soon as the object is detected in the other identification region or also only it has been detected that the other identification region has been left (in the direction away from the hazard zone).

Preferably, the method according to the invention can furthermore also be embodied such that, following the identification that the hazard zone has been left, the closure of the at least one barrier of the level crossing is initiated. This embodiment is in particular also advantageous in the case of a level crossing with an on-call barrier since a corresponding automatic closure enables it to be returned to its standby status. Hence, corresponding developments of the method according to the invention enable on-call barriers to be automated and allowed to act autonomously even without an interface to the signal box. This is associated with the advantage of greater cost efficiency of level crossings with on-call barriers and thus can help to maintain the on-call barrier principle for correspondingly infrequently used level crossings. To avoid any misunderstanding, it is noted at this point that in the case of the corresponding completely or partially automated operation of a level crossing with an on-call barrier, as a rule it is necessary to ensure by means of appropriate sensors on the route that the barrier is not opened at the incorrect time, i.e. if a train is approaching.

During the course of the method according to the invention, it is in principle possible to use radio modules of any type. This means that the emitted radio signals can be formed in accordance with any communication standard that is known per se. This in particular includes radio modules for mobile radio standards of the first, second, third, fourth and fifth generations.

According to a further embodiment of the method according to the invention, the first radio signals and the second radio signals are in each case emitted by means of a first radio module and by means of a second radio module in the form of a WLAN module. This is advantageous since WLAN (wireless local area network) technology, i.e. in particular communication systems using the protocol IEEE 802.11, is a widely used technology that is employed for numerous applications in both the private field and in industry with a higher degree of reliability and performance. Appropriate WLAN modules are, therefore, available on the market in inexpensive, reliable and robust embodiments and can be used in the context of the described embodiment of the method according to the invention for indirect monitoring of the hazard zone of the level crossing.

Preferably, the method according to the invention can also be embodied such that the first radio module and/or the second radio module are additionally also used for Car2X communication. Here, Car2X communication should be understood to mean communication between the level crossing or a control facility thereof and motor vehicles located in the region of the level crossing and optionally also between the level crossing and trains approaching said level crossing. The use of radio modules that are also used for Car2X communication during the course of the monitoring of the hazard zone of the level crossing is advantageous in that it enables the use of commercial communication technology from the automobile sector which is becoming available at increasingly lower prices. At the same time, such radio modules that are or have been installed in the region of level crossings for the purpose of Car2X communication can advantageously also be used to monitor the hazard zone of the level crossing with little additional effort.

According to a further particularly preferred embodiment of the method according to the invention, during the course of the analysis, environmental information and/or information on an operating sequence customary for the level crossing is taken into account. A customary operating sequence of this kind, can, for example, be one that is usually used at level crossings with on-call barriers. Examples of environmental information that can be taken into account during the course of the analysis are additionally acquired audio information or noises or even information acquired by means of vibration sensors or electrical conductor loops laid in the roadway.

The invention moreover relates to a device for monitoring a hazard zone of a level crossing, which divides a roadway into a first roadway section and a second roadway section.

Such a device is also known from the company publication cited in the introduction.

With regard to the device, the present invention is based on the object of disclosing a device for monitoring a hazard zone of a level crossing that is relatively simple and inexpensive to implement.

This object is achieved according to the invention for a device for monitoring a hazard zone of a level crossing, which divides a roadway into a first and in a second roadway section by a first radio module for emitting first radio signals into a first identification region at least partially comprising the first roadway section, a second radio module for emitting second radio signals into a second identification region at least partially comprising the second roadway section and a analysis facility for indirectly monitoring the hazard zone using an analysis relating to the identification regions, which is based on both the first emitted radio signals and the second emitted radio signals.

The advantages of the device according to the invention correspond to those of the method according to the invention and therefore reference is made in this regard to the corresponding statements made above. The same applies with respect to the preferred development of the device according to the invention described below in relation to the respective corresponding preferred development of the method according to the invention and therefore reference to the corresponding above explanations is also made in this regard.

The device according to the invention can preferably be developed such that it is configured to carry out the method according to one of the aforementioned preferred developments of the method according to the invention.

BRIEF DESCRIPTION OF THE SEVERAL VIEWS OF THE DRAWING

The following describes the invention in more detail with reference to exemplary embodiments.

DETAILED DESCRIPTION OF THE INVENTION

Figure 1:
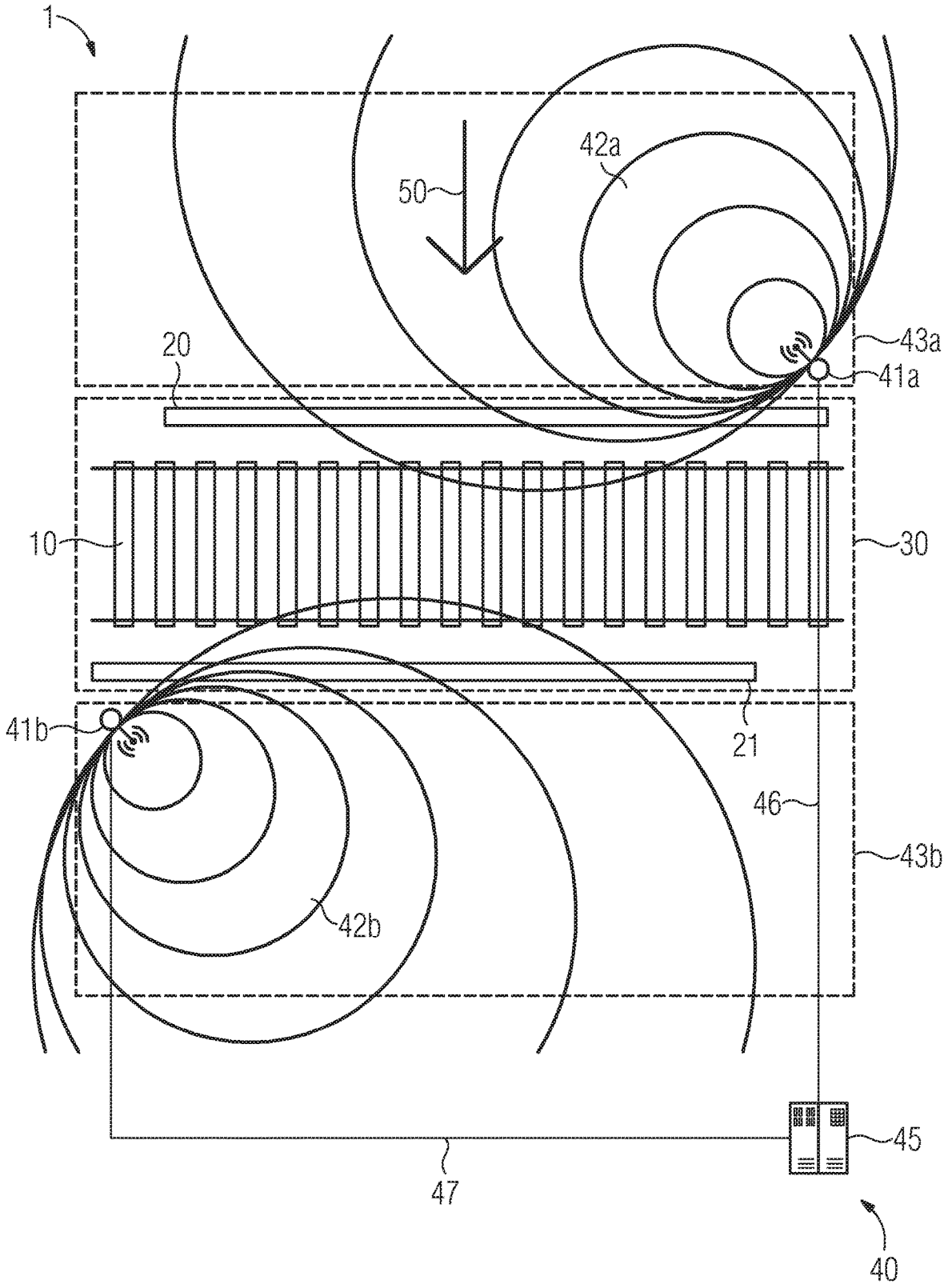
FIG. 1 a schematic sketch of a level crossing and an exemplary embodiment of the device according to the invention, FIG. 2 a schematic diagram of a signal profile obtained according to an exemplary embodiment of the method according to the invention in a first situation for a first radio module as a function of time, FIG. 3 a schematic diagram of a signal profile obtained according to the exemplary embodiment of the method according to the invention in a second situation for the first radio module as a function of time, FIG. 4 a schematic diagram of a signal profile obtained according to the exemplary embodiment of the method according to the invention in the second situation for a second radio module as a function of time and FIG. 5 a schematic sketch in the form of a sequence diagram of method steps executed during the course of a further exemplary embodiment of the method according to the invention.

For reasons of clarity, in the figures the same reference characters are used for the same components or components that have the same effect.

FIG. 1 is a schematic sketch showing a level crossing and an exemplary embodiment of the device according to the invention. This is a top view of a level crossing 1 with a track 10 and barriers 20 and 21. The level crossing 1 divides a roadway into a first roadway section (in the depiction above the level crossing 1) and a second roadway section (in the depiction below the level crossing 1). The intersection between the track 10 and the roadway in the region of the level crossing 1 results in the formation of a hazard zone 30 in a region between the barriers 20 and 21. For the purposes of the safe operation of the associated railroad system and to avoid hazards for traffic participants, here, it is necessary to ensure that there are no people or objects in the hazard zone 30 when the barriers 20, 21 are closed and in particular on the transit of a train.

In order to enable monitoring for this purpose, a device 40 is provided to monitor the hazard zone 30 of the level crossing 10. Herein, the device 40 comprises a first radio module 41*a* and a second radio module 41*b*. Here, the first radio module 41*a* is arranged and embodied such that it emits first radio signals 42*a* into a first identification region 43*a* at least partially comprising the first roadway section. In a corresponding manner, the second radio module 41*b* is arranged and embodied such that it emits second radio signals 42*b* into a second identification region 43*b* at least partially comprising the second roadway section. Here, the identification regions 43*a*, 43*b* can also be called "approach and departure regions". In the context of the exemplary embodiment, it is assumed that the radio modules 41*a* and 41*b* are in each case at the level of the barriers 20, 21 and directed toward the approach and departure regions (and not, for example, toward the region between the barriers 20, 21, i.e. the hazard zone 30).

Both the radio modules 41*a*, 41*b* are embodied to transmit and receive radio signals. In the context of the described exemplary embodiment, it is assumed that the radio modules 41*a*, 41*b* are WLAN modules, i.e. in particular radio modules that emit and receive radio signals according to the communication standard IEEE 802.11.

In the context of the described exemplary embodiment, it is further assumed that the radio modules 41*a*, 41*b* are modules that are additionally also used for Car2X communication. This means that the radio modules 41*a*, 41*b* also provide communication with motor vehicles arranged in the region of the level crossing 1 and/or with a rail vehicle approaching the level crossing 1.

The device 40 for monitoring the hazard region 30 of the level crossing 1 moreover comprises an analysis facility 45, which is connected to the radio modules 41*a* and 41*b* via communication links 46 and 47. Herein, the communication links 46, 47 can be both wireless and wired. The received signals of the radio modules 41*a*, 41*b* are forwarded by these to the analysis facility 45 and where they are analyzed. For this purpose, the analysis facility 45 comprises both hardware components, for example in the form of at least one corresponding processor and one storage facility, and software components, for example in the form of corresponding programs and analysis routines. The analysis facility 45 can, on the one hand, be an independent component, which can be arranged either in the region of the level crossing 1 or remote therefrom. Moreover, the analysis facility 45 can also be embodied as a component of a level crossing control system or also as a component of the radio modules 41*a*, 41*b* or a control facility assigned thereto. Furthermore, it is also possible for the analysis facility 45 to be a distributed system formed by a plurality of (the aforementioned) components, which can optionally also be arranged remote from one another.

The arrangement or device 40 for monitoring the hazard zone 30 of the level crossing 1 depicted in FIG. 1, which divides the roadway into the first roadway section and the second roadway section can now be operated such that first radio signals 42*a* are emitted by means of the first radio module 41*a* into the first identification region 43*a* comprising at least one part of the first roadway section. In a corresponding manner, second radio signals 42*b* are emitted by means of the second radio module 41*b* into the second identification region 43*b* comprising at least one part of the second roadway section. Here, the hazard zone 30 is monitored indirectly using an analysis relating to the identification regions 43*a* and 43*b*, which is based on both the first emitted radio signals 42*a* and the second emitted radio signals 42*b*. As stated above, here the first radio module 41*a* and the second radio module 41*b* preferably in each case also receive radio signals. This enables the hazard zone 30 to be monitored indirectly using an analysis relating to the identification regions 43*a*, 43*b*. Here, preferably, during the course of the analysis, the first radio module 41*a* exclusively takes into account the first radio signals 42*a* and the second radio module 41*b* exclusively takes into account the second radio signals 42*b*.

The analysis can be performed by the analysis facility 45 taking into account a received power of the radio signals received by the respective radio module 41*a*, 41*b* and/or taking into account a respective running time of the radio signals received by the respective radio module 41*a*, 41*b*.

In the context of the described exemplary embodiment, it is assumed that an object approaches the level crossing 1 in a direction of movement 50 and here has reached the first identification region 43*a*. In this case, the object in the identification region 43*a* is identified during the course of the analysis. Thereby, the identification can relate solely to the presence of the object or additionally also to the type of object (motor vehicle, pedestrian, etc.). Moreover, in addition to the identification of the object it is optionally additionally also possible for a direction of movement of the object to be detected or established. In particular in the event of the level crossing 1 being a level crossing with on-call barriers, following the identification of the object, the opening of the barriers 20, 21 of the level crossing 1 can be initiated. A prerequisite for this is either communication with a signal box or a link to trackside sensors, for example in the form of radio-operated approach annunciators or wheel sensors, which optionally report that a train is approaching the level crossing 1 and thus prevent the barriers 20, 21 from opening at the incorrect time.

Preferably, subsequently, during the course of the analysis, the analysis facility 50 identifies that the object has moved out of the first identification region 43*a* into the hazard zone 30. This can take place, optionally taking into account a detected direction of movement, for example in that it is identified that the object has left the first identification region 43*a*. In the further course of the method, at a later time during the course of the analysis, the object can now subsequently be identified or detected in the other, i.e. second, identification region 43*b*. Either in this situation or when the object has also left the second identification region 43*b* again following the roadway, during the course of the analysis, the analysis facility 45 can identify or establish that the object has left the hazard zone 30 again. Thereupon, the analysis facility 45 can initiate the closure of the barriers 20, 21 of the level crossing 1 as a result of which it is returned to its standby status. During the course of the analysis, the analysis facility 45 can additionally also take into account environmental information and/or information on an operating sequence customary for the level crossing 1.

Figure 2:
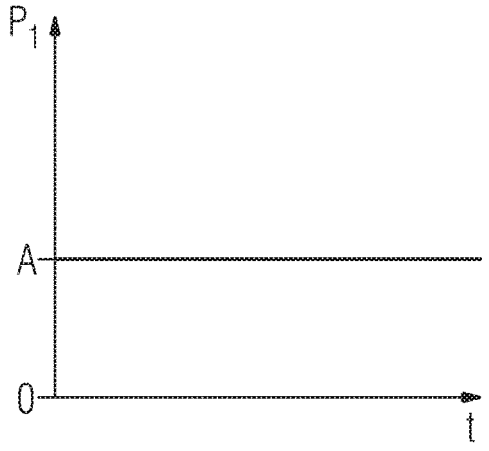

FIG. 2 is a schematic diagram of a signal profile obtained according to an exemplary embodiment of the method according to the invention in a first situation for a first radio module as a function of time. This depicts a received power $P_1$ of the first radio module 41*a* as a function of time t. Herein, the level crossing 1 is in a standby status to the extent that the two identification regions 43*a* and 43*b* are unoccupied or free and also the environment otherwise also corresponds to its customary condition. In this standby status, the first radio module 41*a* receives reflected signals of the first radio signals 42*a*, which lead to a constant standby received power A for the first radio module 41*a*. In a corresponding manner, it is assumed that, for the second radio module 41*b*, a standby received power B is obtained which, depending on the respective circumstances, can be identical to the standby received power A of the first radio module 41*a* or also different therefrom.

If now, during the course of the operation of the level crossing 1, deviations from the respective standby status occur, these can be identified using an analysis of the respective received powers of the radio modules 41*a*, 41*b* from which conclusions can be drawn regarding the status of the hazard zone 30 of the level crossing 1. This is explained by way of example in the following with reference to FIGS. 3 and 4.

Figure 3:
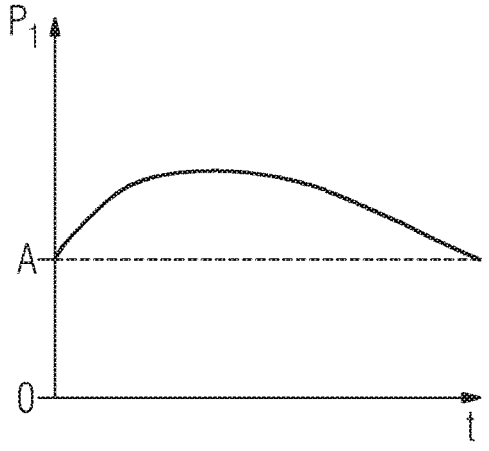

FIG. 3 is a schematic diagram of a signal profile obtained according to the exemplary embodiment of the method according to the invention in a second situation for the first radio module 41*a* as a function of time t. Here, a status of the level crossing 1 is depicted in which an object according to the depiction in FIG. 1 approaches the level crossing from the side with the first identification region 43*a* and leaves it again via the second identification region 43*b*. In this situation or during this process, it can be identified in relation to the received power $P_1$ of the first radio module 41*a* that this initially increases significantly as a result of the object entering the first identification region 43*a* and the associated reflection of the radio signals 42*a*. Subsequently the received power $P_1$ then drops again until ultimately the value A of the standby received power of the first radio module 41*a* is restored.

Figure 4:
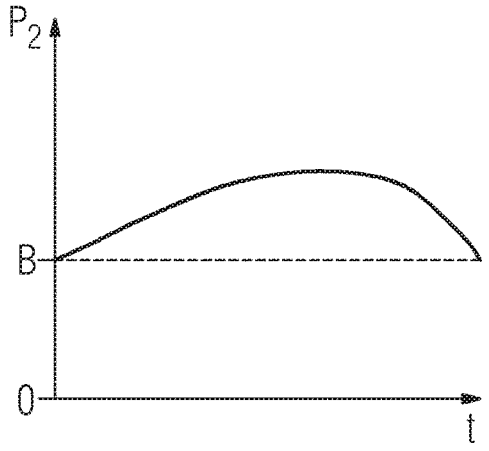

At this point, express reference is made to the fact that that the depictions in FIGS. 3 and 4 are only exemplary curve profiles. This means that in practice, depending on the respective conditions and circumstances, it is also possible for significantly different curve profiles to be obtained.

FIG. 4 is a schematic diagram of a signal profile obtained according to the exemplary embodiment of the method according to the invention in the second situation for a second radio module as a function of time. Hence, FIG. 4 depicts the respective received power $P_2$ of the second radio module 41*b* as a function of time t. Here, it may be identified that this is substantially a mirror image of the profile depicted in FIG. 3 to the extent that the received power $P_2$ of the second radio module 41*b* reaches its maximum when the object in question is located in the second identification region 43*b* and thus causes particularly pronounced reflections of the second radio signals 42*b*. Here, the respective reflected signals are in particular dependent on the size and nature of the respective object. Corresponding encoding, for example a corresponding identifier in a header of the emitted radio signals 42*a*, 42*b*, enables the radio modules 41*a*, 41*b* in each case to identify or differentiate the first radio signals 42*a* and the second radio signals 42*b* so that, during the analysis by the analysis facility 45, preferably only the radio signals 42*a*, 42*b* emitted by the actual respective radio module 41*a*, 41*b* or the received radio signals based thereupon are taken into account.

Figure 5:
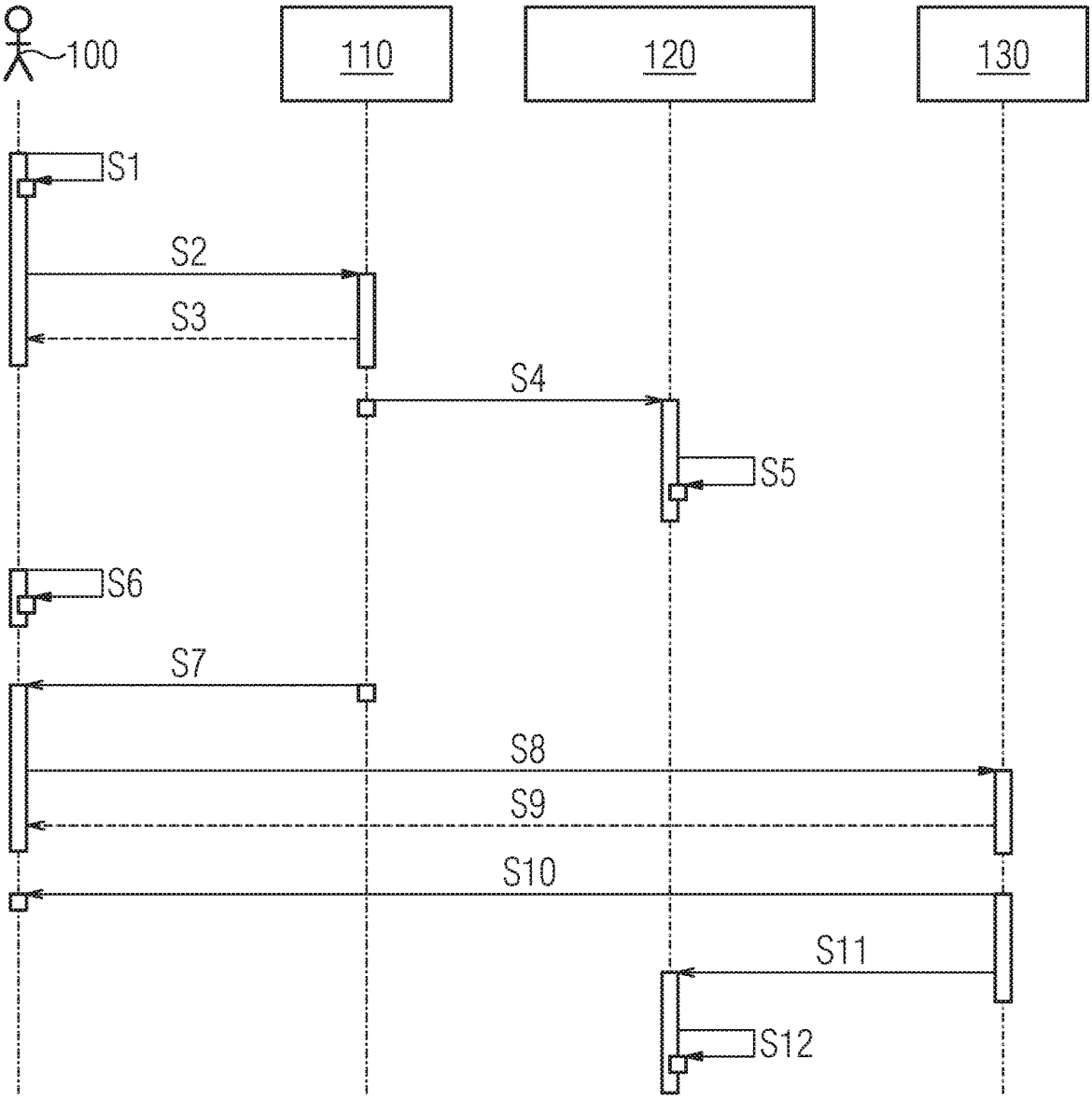

FIG. 5 is a schematic sketch in the form of a sequence diagram of method steps executed during the course of a further exemplary embodiment of the method according to the invention. The exemplary embodiment of the method according to the invention in connection with FIG. 5 relates to the case of a level crossing with an on-call barrier. Herein, the sequence diagram indicates a roadway traffic participant 100, a first radio module 110, a level crossing safety system 120 and a second radio module 130.

With respect to the level crossing safety system 120, it is noted at this point that this can comprise or correspond to the analysis facility 45 according to the exemplary embodiment in FIG. 1. In this context, reference is made to the fact that it is also possible with the exemplary embodiment according to FIG. 1 for at least parts of the analysis or detection to be performed by the actual respective radio module 41*a*, 41*b* in which case corresponding information is sent to the analysis facility 45, which takes this into account during the course of the further analysis.

According to the exemplary embodiment in FIG. 5, in a first step S1, the roadway traffic participant 100 approaches the level crossing. Here, in a step S2, the roadway traffic participant reaches a first identification region of the first radio module 110 following which, in a step S3, the first radio module 110 or an analysis facility connected to the first radio module 110 by means of communication technology identifies the roadway traffic participant or the presence thereof in the first identification region on the basis of reflected radio signals.

Following the identification of the object in the form of the roadway traffic participant 100, the first radio module 110 initiates the opening of the barrier or barriers of the level crossing. In the context of the described exemplary embodiment, this takes place in a step S4 by means of a corresponding message to the level crossing safety system 120. This checks or ensures that no train is currently approaching the level crossing and then opens the barrier or barriers in a step S5.

In a step S6, the roadway traffic participant 100 then crosses the level crossing, wherein in a step S7, the crossing process is observed using an analysis of the first radio signals of the first radio module 110. In a subsequent step S8, the roadway traffic participant 100 reaches a second identification region assigned to the second radio module 130, which, in a step S9, then identifies the object in the form of the roadway traffic participant 100. According to a step S10, the further crossing process is observed based on an analysis of the second radio signals of the second radio module 130 or received signals caused thereby. When, on the basis of this, it is identified that the roadway traffic participant 100 has left the second identification region, or at least the hazard zone, again, in a step S11, the second radio module 130 initiates or requests the closure of the barrier or barriers of the level crossing. This closure is then performed by the level crossing safety system 120 in a step S12.

Reference is made to the fact that the individual functions in respect of the analysis of the respective radio signals and the identification of objects can evidently also be distributed between the components involved. Regardless of this, it is clear from the process described in connection with the exemplary embodiment according to FIG. 5 that the described method enables automation of the operation of level crossings with on-call barriers and optionally autonomous action of level crossings without this mandatorily requiring an interface to a signal box. This can achieve significant advantages in practice in respect of the economic efficiency of corresponding level crossings.

According to the above statements, the described exemplary embodiments of the method according to the invention and the device according to the invention in particular have the advantage that they enable indirect monitoring of the hazard zone of level crossings for little cost and effort. Herein, the monitoring can in particular take place using commercially available COTS (commercial off-the-shelf) communication technology, which is available at increasingly low prices. Examples of this are the radio modules used in automobile or roadway traffic technology in the form of WLAN modules used in the 5.9 frequency range for Car2X communication. Optionally, here they can also be used in combination/sequence with other hazard zone free status reporting systems.

Moreover, in particular in the case of level crossings with on-call barriers, it is possible to assist the dispatcher with automatic hazard zone free status reports (which may not be safety relevant or may not have reliable signaling technology) and/or to implement a completely automated and autonomous mode of operation. Depending upon the respective circumstances and the respective implementation, this may obtain significant increase in safety.

The invention claimed is:

1. A method for monitoring a hazard zone of a level crossing, which comprises the steps of:

dividing a roadway into a first roadway section and a second roadway section;

emitting first radio signals by means of a first radio module being a device used for radio-based communication by means of a corresponding transmission of data by means of the first radio signals into a first identification region containing at least one part of the first roadway section;

emitting second radio signals by means of a second radio module being a device used for radio-based communication by means of a corresponding transmission of data by means of the second radio signals into a second identification region containing at least one part of the second roadway section; and monitoring the hazard zone indirectly using an analysis of the first and second radio signals received relating to the first and second identification regions, which is based on both the first emitted radio signals and on the second emitted radio signals.

2. The method according to claim 1, which further comprises:

receiving in each case the first and second radio signals by means of the first radio module and the second radio module; and monitoring the hazard zone indirectly using an analysis relating to the first and second identification regions, which is based on the first and second radio signals received.

3. The method according to claim 2, wherein during a course of the analysis, the first radio module exclusively takes into account the first radio signals and the second radio module exclusively takes into account the second radio signals.

4. The method according to claim 2, which further comprises performing the analysis taking into account a received power of the first and second radio signals received by the first and second radio modules.

5. The method according to claim 2, which further comprises performing the analysis taking into account a running time of the first and second radio signals received by the first and second radio modules.

6. The method according to claim 1, wherein during a course of the analysis, an object is identified in one of the first and second identification regions.

7. The method according to claim 6, wherein following an identification of the object, initiating an opening of at least one barrier of the level crossing.

8. The method according to claim 6, wherein during a course of the analysis, it is identified that the object has moved out of the one of the first and second identification regions into the hazard zone.

9. The method according to claim 6, wherein during a course of the analysis, the object is subsequently identified in the other one of the first and second identification regions.

10. The method according to claim 8, wherein during a course of the analysis, it is identified that the object has left the hazard zone again.

11. The method according to claim 10, which further comprises following an identification that the hazard zone has been left, initiating a closure of at least one barrier of the level crossing.

12. The method according to claim 1, which further comprises emitting the first radio signals and the second radio signals in each case by means of the first radio module and by means of the second radio module being in a form of a wireless local area network module.

13. The method according to claim 1, wherein the first radio module and/or the second radio module is/are used for Car2X communication.

14. The method according to claim 1, wherein during a course of the analysis, taking into account environmental information and/or information on an operating sequence for the level crossing.

15. A device for monitoring a hazard zone of a level crossing, the device dividing a roadway into a first roadway section and a second roadway section, the device comprising:

a first radio module being a device used for radio-based communication by means of a corresponding transmission of data by emitting first radio signals into a first identification region at least partially containing the first roadway section;

a second radio module being a device used for radio-based communication by means of a corresponding transmission of data by emitting second radio signals into a second identification region at least partially containing the second roadway section; and an analysis facility for indirect monitoring of the hazard zone using an analysis relating to the first and second identification regions which is based on both the first emitted radio signals and the second emitted radio signals.

16. The device according to claim 15, wherein the device is configured to:

receive in each case the first and second radio signals by means of said first radio module and said second radio module; and monitoring the hazard zone indirectly using an analysis relating to the first and second identification regions, which is based on the first and second radio signals received.

* * * * *